US006039268A

United States Patent [19]

Grundy et al.

[11] Patent Number: 6,039,268

[45] Date of Patent: Mar. 21, 2000

[54] ARC MARKING SYSTEM FOR SPRINKLER

[75] Inventors: Michael J. Grundy, Phelan; James T. Wright, Riverside, both of Calif.

[73] Assignee: The Toro Company, Minneapolis, Minn.

[21] Appl. No.: 09/083,471

[22] Filed: May 22, 1998

[51] Int. Cl.[7] ..... B67D 5/08

[52] U.S. Cl. ..... 239/73; 239/206

[58] Field of Search ..... 239/DIG. 1, 203, 239/204, 205, 206, 71, 73, 74; 116/200, 280

[56] References Cited

U.S. PATENT DOCUMENTS

| | | | |
|---|---|---|---|
| 2,729,504 | 1/1956 | Zukas | 239/71 |
| 3,452,930 | 7/1969 | Karbo | 239/71 |
| 3,779,462 | 12/1973 | Bruninga | 239/230 |
| 4,570,858 | 2/1986 | Bintner et al. | 239/390 |
| 4,739,934 | 4/1988 | Gewelber | 239/446 |
| 4,867,378 | 9/1989 | Kah | 239/206 |
| 5,141,157 | 8/1992 | Han et al. | 239/206 |
| 5,451,000 | 9/1995 | Shaw et al. | 239/71 |
| 5,456,411 | 10/1995 | Scott et al. | 239/73 |
| 5,868,316 | 2/1999 | Scott | 239/73 |

OTHER PUBLICATIONS

Toro Installation Instructions for 620 Series Sprinkler, 1979.
Toro 1982 Irrigation Catalog, p. 21.

*Primary Examiner*—Andres Kashnikow
*Assistant Examiner*—J. Bocanegra
*Attorney, Agent, or Firm*—James W. Miller

[57] ABSTRACT

An arc marking system is provided for a sprinkler that waters an arc, either a full circle arc or a part circle arc. The system includes a plurality of arc indicators provided on the top of the nozzle assembly. Each arc indicator is adjacent an arc indicia such that each arc indicator represents a different arc that this sprinkler is capable of watering. After ascertaining the arc that a particular sprinkler can water, the arc information can be marked on the nozzle assembly by cutting off the arc indicator that is adjacent the numeral that represents the number of degrees covered by the arc. Thus, the arc information is added to the top of the sprinkler where it can be easily seen.

15 Claims, 2 Drawing Sheets

ARC MARKING SYSTEM FOR SPRINKLER

TECHNICAL FIELD

This invention relates to a sprinkler that waters a fixed, non-adjustable arc. More particularly, this invention relates to such a sprinkler with a system for marking the arc the sprinkler waters.

BACKGROUND THE INVENTION

Various sprinklers have a rotatable nozzle assembly that includes a nozzle which throws at least one water stream outwardly to one side of the nozzle assembly. As the nozzle assembly rotates, the water stream thrown from the nozzle travels or sweeps over the ground. In a true full circle sprinkler, the nozzle assembly is continuously driven in a single direction without reversing to water a circular area surrounding the sprinkler. In a part circle sprinkler, the nozzle assembly oscillates back and forth between two stops to water a portion of a circle.

Some oscillating sprinklers are adjustable. The user can selectively set the distance between the two stops, which is known as adjusting the arc, to adjust the angular extent of the portion of a circle that is watered. This is done by some type of adjustment mechanism provided on the sprinkler. In some adjustable arc sprinklers, a scale adjacent the adjustment mechanism lets the user see what arc has been set.

Other oscillating sprinklers are not adjustable but are manufactured with fixed arcs of oscillation. In other words, a fixed arc oscillating sprinkler is one in which the distance between the two stops is fixed by the manufacturer and cannot subsequently be adjusted by the user. Different models of fixed arc sprinklers are typically sold by the manufacturer to water different angular portions of a circle. But, for any particular sprinkler, that sprinkler will water only one particular fixed arc as determined by the manufacturer at the time that sprinkler is built.

In the sprinklers described above, whether full circle sprinklers or adjustable or fixed arc oscillating sprinklers, the nozzle assembly is rotated by a rotary drive. The rotatable nozzle assembly sits atop the drive and is connected to an output shaft that sticks up out of the drive. As the drive operates and the output shaft is rotated, the nozzle assembly rotates on top of the drive. Often, the nozzle assembly and the drive form a riser that pops up and down inside an outer sprinkler body, the riser normally being retracted into the sprinkler body when the sprinkler is off.

When a manufacturer builds rotary sprinklers having fixed, non-adjustable arcs, namely either full circle sprinklers or fixed arc oscillating sprinklers, the drives and nozzle assemblies are manufactured separately and mated together at a later time during the assembly process. In some cases, the drives and nozzle assemblies may not be mated together by the manufacturer at all. The manufacturer might simply sell sprinklers having drives but without any nozzle assemblies pre-installed on those drives. The sprinkler distributor or purchaser of such sprinklers places a desired nozzle assembly on top of the drive at some later time, namely when the distributor is filling a particular order from a purchaser or when the purchaser is actually installing sprinklers in the field. This allows the purchaser to customize a particular sprinkler by installing a nozzle assembly having desired trajectory or flow rate characteristics.

The manufacturer typically marks the side of the drive with the arc that such drive is designed to water. For example, a full circle drive will be marked with the number 360 indicating that the drive is a full circle drive intended to water 360°. An oscillating sprinkler drive built to water half a circle will be marked by the number 180 representing 180°. However, this marking information is only on the side of the drive and is not usually visible to someone looking down on the sprinkler from above since the drive is typically retracted within the sprinkler body. Thus, when the sprinkler is not operating and the riser is retracted inside the body, the drive cannot be seen at all. Only the top of the sprinkler is visible.

Even though the arc being watered by the sprinkler is marked on the drive when the drive is built, the same information is not provided on the nozzle assembly because of the variety of different nozzle assemblies that might later be mated to the drive. Thus, when this mating is eventually done, whether by the manufacturer during a later manufacturing step or by a sprinkler distributor or purchaser following manufacture, it would be desirable for this arc information to be marked on the nozzle assembly itself. However, prior to this invention, there has been no way to permanently and durably mark the arc that the drive is constructed to water on the nozzle assembly or on some other portion of the sprinkler.

SUMMARY OF THE INVENTION

One aspect of this invention is an arc marking system for a sprinkler having a nozzle assembly. The arc marking system comprises a plurality of arc indicators carried on the sprinkler. The plurality of arc indicators represent different arcs. The arc indicators are selectively changeable from one condition to another condition such that the user can selectively change the condition of one of the arc indicators compared to the condition of the other arc in dicators that remain unchanged to thereby mark the arc represented by the arc indicator whose condition was changed.

Another aspect of this invention is an arc marking system of this type in which the arc indicators are severable such that the arc can be marked on the sprinkler by severing the one arc indicator that is correlated with the arc indicia that represents the arc that the sprinkler will water.

Another aspect of this invention is to provide a sprinkler which includes a nozzle assembly having at least one nozzle. A drive is provided for rotating the nozzle assembly which drive is configured to water a fixed, non-adjustable arc. A means is carried on the nozzle assembly for selectively marking the arc the drive is configured to water.

Yet another aspect of this invention is to provide a sprinkler which includes a sprinkler body having an upper end which carries a cap. A riser pops up and down within the sprinkler body with the riser extending through an opening in the cap. The riser includes a nozzle assembly having at least one nozzle. A drive is provided for rotating the nozzle assembly which drive is configured to water a fixed, non-adjustable arc. Finally, a means is carried on at least one of the cap or the nozzle assembly for selectively marking the arc the drive is configured to water.

BRIEF DESCRIPTION OF THE INVENTION

A better understanding of the invention can be had by reference to the following Detailed Description in conjunction with the accompanying Drawings, wherein.

DETAILED DESCRIPTION

Figure 1:
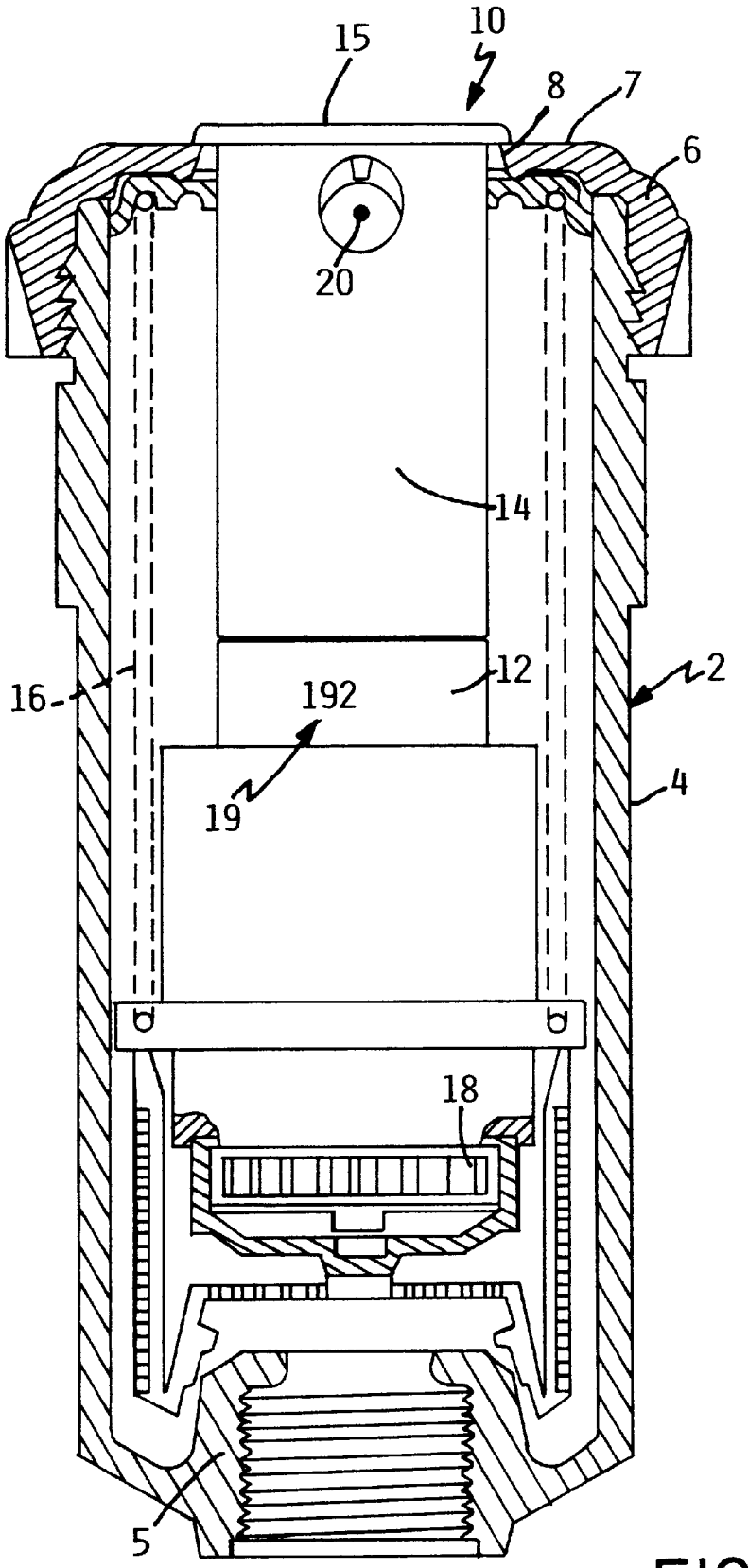
FIG. 1 is a side elevational view, partly in cross-section, of a typical rotary, pop-up sprinkler showing the riser retracted within the sprinkler body.

Referring now to the Drawings, wherein like reference numerals designate like or corresponding elements throughout the views, one type of sprinkler is illustrated as 2 in FIG. 1. Sprinkler 2 includes an outer cylindrical sprinkler body 4 having a threaded inlet 5 for attachment to a pipe carrying water under pressure. A cap 6 closes the upper end of body 4 by threading onto body 4 or by being attached to body 4 in some other manner. Cap 6 includes a top 7 having an opening 8 through which a riser 10 pops up and down.

Riser 10 is made primarily of two parts, namely a rotary drive 12 which rotatably mounts a nozzle assembly 14. Drive 12 is preferably a hydraulic drive operated by the water flowing through sprinkler 2. A turbine 18 spun by the force of the water flowing through sprinkler 2 operates a reduction gear train (not shown) within drive 12. The output shaft (not shown) of this gear train is coupled to nozzle assembly 14 to rotate nozzle assembly 14 atop drive Nozzle assembly 14 includes at least one nozzle 20 in the side thereof. When the sprinkler is turned off, a spring 16 retracts riser 10 within outer body 4 as shown in FIG. 1 with drive 12 and most of nozzle assembly 14, including nozzle 20, being contained within body 4. However, when sprinkler 2 is turned on, the force of the water entering body 4 through inlet 5 causes riser 10 to pop up out of body 4 against the force of spring 16 until much of nozzle assembly 14 is located above cap 6. The water passing through drive 12 eventually passes through nozzle assembly 14, using internal water flow passageways (not shown) to be ejected in a stream outwardly through nozzle 20.

Nozzle assembly 20 rotates around on top of drive 12 during operation of sprinkler 2. The stream ejected by nozzle 20 travels or sweeps over the ground to water a circle, or a portion of a circle, surrounding sprinkler 2. In a full circle sprinkler, drive 12 operates unidirectionally to water a 360° arc, i.e. a full circle, surrounding sprinkler 2. In an oscillating sprinkler, drive 12 is reversible to allow the sprinkler to oscillate back and forth between two stops. When these two stops are positioned less than 360° apart, such an oscillating sprinkler will water only portion of a circle, and thus is often called a part circle sprinkler.

The type of drive 12 used to impart rotary motion to nozzle assembly 14 is not important to this invention. It can include a rotary gear drive having a reduction gear train, as described above, or a ball drive, or some other type of impact drive. In an oscillating part circle sprinkler, the type of structure used to reverse the drive can vary.

In the context of this invention, the term "arc" will refer to the angular extent of the pattern being watered by sprinkler 2. Thus, in a full circle sprinkler designed to water a circle comprising 360°, the "arc" being watered will be 360°. Similarly, in a part circle sprinkler designed to water only a portion of a circle, the "arc" being watered will be the number of degrees covered by the particular portion of a circle. In the case of a half circle sprinkler, the "arc" will be 180°. Thus, the term "arc" can refer to a full circle or less than a full circle as just described.

In sprinklers that are built to water fixed, nonadjustable arcs, it is common for the manufacturer to mark or label the side of drive 12 with a numeral representing the arc the drive will water. Thus, FIG. 1 assumes the sprinkler is a part circle sprinkler whose drive 12 is built to water 192°, one of the standard part circle Series 640 sprinklers that are offered by The Toro Company, the assignee of this invention. Accordingly, the numeral 192 on the side of drive 12, which numeral is indicated at 19, tells the user the drive will water 192° to let the user know the arc drive 12 will water. While this information may or may not be visible to the user when riser 10 is popped up depending upon the stroke of riser 10 and where the marking is placed on drive 12, it is certainly not visible to the user when sprinkler 2 is off. When sprinkler 2 is off, the only visible portion of riser 10 is the top 15 of nozzle assembly 14.

Figure 2:
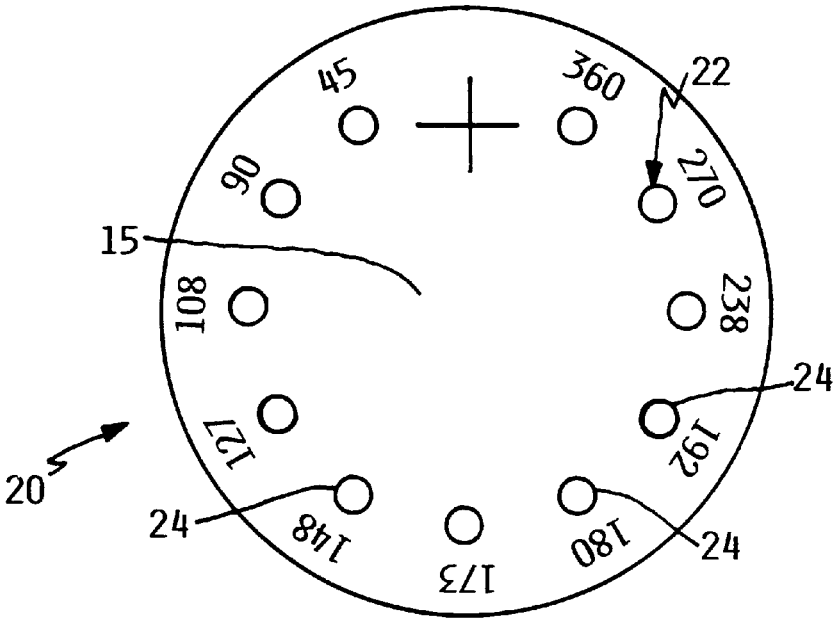
FIG. 2 is a top plan view of the top of a nozzle assembly which can be used on the sprinkler of FIG. 1, particularly illustrating the arc marking system of this invention.
Figure 3:
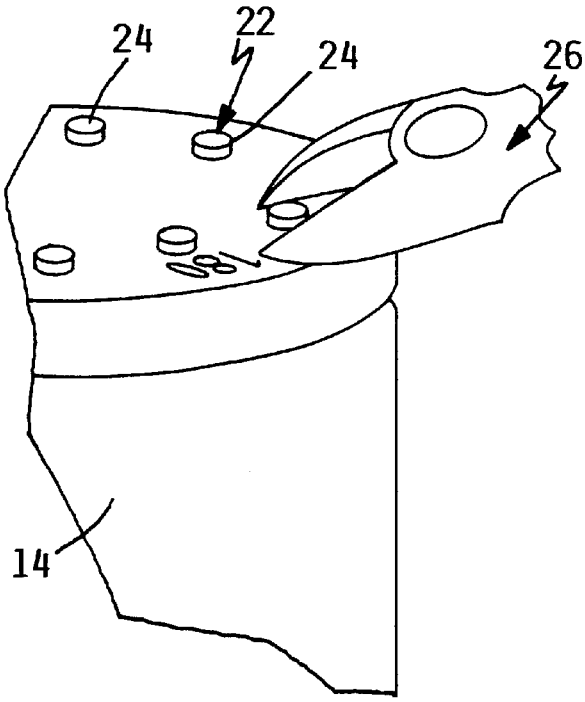
FIG. 3 is a perspective view of the top surface of the nozzle assembly shown in FIG. 2, particularly illustrating the severing of one of the arc indicating projections to mark the arc the drive will water.
Figure 4:
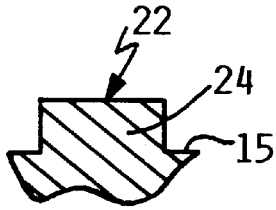
FIG. 4 is a cross-sectional view through one of the arc indicating projections shown in FIG. 2.

This invention relates to an arc marking system having a means 20 for selectively marking the arc that drive 12 is designed to water on some portion of sprinkler 2 such as nozzle assembly 14. Referring now to FIGS. 2–4, arc marking means 20 of this invention comprises a plurality of arc indicators 22 formed on top 15 of nozzle assembly 14. Each arc indicator 22 carries or is located adjacent a numeral or other arc indicia which indicates one of the fixed arcs that drive 12 might possibly water. In the example shown in FIGS. 2–4, drive 12 might possibly water any one of eleven different arcs, beginning with a 459 arc and ending with a 360° arc, depending on the type of fixed, non-adjustable drive 12 installed in sprinkler 2. Thus, eleven arc indicators 22 are located on nozzle assembly top 15 next to eleven different numerals which indicate the various different arcs that drive 12 might potentially water.

Arc indicators 22 have a changeable condition so that one indicator 22 might be selectively changed from one condition to another to be different than the rest of the indicators 22. Thus, the arc covered by drive 12 can be selectively marked on nozzle assembly 14 by changing the condition of whichever arc indicator 22 is adjacent the numeral that represents the arc the drive 12 will water. Thus, assuming that drive 12 waters a 192° arc, arc indicator 22 adjacent the numeral 192° can have its condition changed relative to the unchanged conditions of the remaining arc indicators to thereby mark the 192° arc on nozzle assembly top 15. Thus, one can quickly and easily ascertain that sprinkler 2 having this drive 12 will water 192° simply by glancing down at the marking on nozzle assembly top 15. This can be done even when sprinkler 2 is off and riser 10 is retracted within outer body 4.

Arc indicators 22 can use different types of changeable conditions. However, one preferred condition that can be changed is the appearance of arc indicator 22 by changing the height thereof. Thus, each arc indicator 22 can comprise an upwardly extending, short, cylindrical projection 24 that sticks up from nozzle assembly top 15. For example, each arc indicator 22 can comprise a cylindrical projection 24 having a diameter of 0.09 inches and a height of 0.06 inches.

Referring now to FIG. 3, a cutting tool 26, such as a pair of scissors or shears or a knife, can be used to cut off that projection 24 which is adjacent the numeral that represents the arc that is to be marked on nozzle assembly 14. For example, referring to FIGS. 2 and 3, projection 24 adjacent the numeral 192 is being cut off to mark on nozzle assembly 14 that drive 12 is built to water an arc of 192°. Thereafter, one need only look at nozzle assembly top 15 to see which projection 24 has been cut off to see what arc the drive 12 is set to water.

In accomplishing marking by severing or changing the height of a projection, as just described, it is preferred that such projections be relatively easy to cut. Accordingly, projections 24 are made of a relatively flexible rubber or plastic material that is soft enough to be easily cut. Since the top surfaces of sprinklers often comprise rubber covers, it is preferred that the arc marking projections 24 and the numerals comprising the arc indicia be integrally molded into such a rubber cover that forms the very top 15 of nozzle assembly 14. Such a rubber projection 24 is easy to cut using commonly available cutting tools 26.

The arc marking can be done selectively at any time. For example, if the sprinkler is shipped from the factory with a nozzle assembly 14 pre-installed on drive 12, then the manufacturer can mark the arc during the assembly process. For example, when the sprinkler arrives at the manufacturing step where nozzle assembly 14 is installed on drive 12, the person doing the nozzle installation can look at the side of drive 12 to ascertain what arc drive 12 is built to water. That person can then grab a pair of scissors and cut off the projection 24 that is adjacent the corresponding numeral on nozzle assembly top 15 to thereby add this arc marking to nozzle assembly top 15. Accordingly, when the sprinkler is subsequently completed with riser 10 being installed within body 4, the arc information will be present on the top 15 of nozzle assembly 14.

Alternatively, if nozzle assembly 14 is mated to a drive at some point after the sprinkler is built, i.e. by a distributor or purchaser, the arc marking can also be easily done at that time. The user would simply push up on riser 10 to extend drive 12 up far enough to allow the user to read the arc marking that is present on the side of drive 12. With this information in mind, the user can then install nozzle assembly 14 on drive 12 and also mark the arc on nozzle assembly 14 in the same way as the manufacturer would, by cutting off that projection 24 adjacent the appropriate numeral representing the arc. With the arc so marked, the user would then be able to easily ascertain what arc this particular sprinkler 2 waters even when drive 12 is retracted within body 4.

The arc marking means 20 of this invention is durable and reliable. It will not wash off or wear away over time. The arc can be easily and quickly marked merely by severing one projection 24. Instead of projections 24 that need to be cut, projections 24 could also be used that could be broken off by hand, i.e. frangible projections having a score line which allows them to be broken off. The advantage of using such frangible projections is that no cutting implements would be needed, but the disadvantage is that they might be accidentally broken off if the sprinkler is dropped or the user's hand accidentally contacts a projection 24. All in all, the use of projections 24 that need to be cut off is preferred as an accidental cutting of a projection 24 is highly unlikely.

While cutting one projection 24 off to change the height and thus the appearance of that projection 24 is one type of changeable condition that can be used, other types of changeable conditions could also be used and would be equivalent to cutting the projection to change its height. For example, if projections 24 were pins that could be pushed down or pulled up relative to nozzle assembly top 15, then the height of one of the pins could be varied relative to the rest, i.e. by pushing down on one of the pins while the rest of the pins remain pulled up. Such pins that can be pushed or pulled are commonly used in irrigation controllers. Alternatively, arc indicators 22 could comprise slides that slide back and forth in radial slots on nozzle assembly top 15. One of the slides could be moved in or out compared to the rest of the slides to mark the arc.

While it is preferred that nozzle assembly top 15 carry arc marking means 20 of this invention, such a means could be placed on an outer exterior portion of sprinkler 2 as well, preferably on a surface that is visible when sprinkler is installed in the ground. For example, when sprinkler 2 is installed in the ground, the body 4 will be buried with the top 7 of the cap 6 and nozzle assembly top 15 being the only visible portions of sprinkler 2. Arc marking means 20, i.e. the series of arc indicators 22 along with the arc indicia, could be placed on the top 7 of the cap 6 on that portion which can be seen from above just as well as on nozzle assembly top 15.

Various other modifications of this invention will be apparent to this skilled in the art. For example, arc marking means 20 is not limited for use on rotary sprinklers having a rotary drive 12, but could be used on fixed spray sprinklers in which the nozzle assembly is configured to water a predetermined arc. Although particular embodiments of the invention have been illustrated in the accompanying Drawings and described in the foregoing Detailed Description, it will be understood that the invention is not limited only to the embodiments disclosed, but is intended to embrace any alternatives, equivalents, modifications and/or rearrangements of elements falling with the scope of the invention as defined by the following claims. Thus, the scope of the invention is to be limited only by the appended claims.

We claim:

1. A system for marking the arc being watered by a sprinkler, which comprises:

a plurality of arc indicators carried on the sprinkler, wherein the plurality of arc indicators represent different arcs, and wherein the arc indicators are changeable from one condition to another condition such that the user can change the condition of one of the arc indicators compared to the condition of the other arc indicators that remain unchanged to thereby mark the arc represented by the arc indicator whose condition was changed.

2. The arc marking system of claim 1, further including indicia means carried on the sprinkler and correlated with the arc indicators such that each arc indicator represents a different arc.

3. The arc marking system of claim 2, wherein the indicia means is separate from the arc indicators and is located adjacent the arc indicators.

4. The arc marking system of claim 1, wherein the arc indicators have a changeable height, and wherein the user changes the condition of the one arc indicator by changing its height relative to the height of the other arc indicators.

5. An arc marking system for a sprinkler that waters an arc, which comprises:

a plurality of arc indicators provided on the sprinkler, each arc indicator being correlated with an arc indicia such that each arc indicator represents a different arc that the sprinkler is capable of watering, the arc indicators being severable such that the arc can be marked on the sprinkler by severing the one arc indicator that is correlated with the arc indicia that represents the arc that the sprinkler will water, whereby the arc covered by the sprinkler can be easily marked on the sprinkler.

6. The arc marking system of claim 5, wherein the arc indicators and the arc indicia are located on some portion of the sprinkler such that the arc indicators and arc indicia can be viewed from above the sprinkler.

7. A sprinkler, which comprises:

(a) a nozzle assembly having at least one nozzle;

(b) a drive for rotating the nozzle assembly through a single, fixed, non-adjustable arc; and (c) means carried on the nozzle assembly for marking the single arc of rotation of the nozzle assembly that the drive is configured to provide, wherein the arc marking means comprises a plurality of arc indicators representing different arcs, wherein the arc indicators are changeable from one condition to another condition such that the user can change the condition of one of the arc indicators, representing the single arc of rotation, compared to the condition of the other arc indicators that remain unchanged to thereby mark the single arc of rotation represented by the arc indicator whose condition was changed.

8. The sprinkler of claim 7, wherein the nozzle assembly has an exterior, and wherein the arc marking means is carried on the exterior of the nozzle assembly.

9. The sprinkler of claim 8, wherein the exterior of the nozzle assembly includes a top, and wherein the arc marking means is carried on the top of the nozzle assembly.

10. The sprinkler of claim 9, wherein the nozzle assembly and drive form part of a riser which is carried in a sprinkler body for movement between a retracted position inside the sprinkler body and a popped up position in which the riser is at least partially extended from the sprinkler body, and wherein the drive is hidden within the sprinkler body when the riser is in the retracted position.

11. The sprinkler of claim 7, wherein the arc indicators have a changeable height, wherein the user changes the condition of the one arc indicator by changing its height relative to the height of the other arc indicators.

12. The sprinkler of claim 7, wherein the arc indicators comprise a plurality of projections that extend outwardly from the nozzle assembly and which are sufficiently soft to allow the projections to be severed from the nozzle assembly, and wherein the user changes the condition of one of the projections by cutting the projection off, thereby lowering the height of the one projection relative to the other projections.

13. The sprinkler of claim 12 wherein the projections are part of a top cover of the nozzle assembly.

14. The sprinkler of claim 13, wherein the projections and the top cover are made as one piece from a relatively soft rubber material.

15.The sprinkler of claim 13, wherein the top cover includes indicia means carried thereon adjacent the projections such that each projection is adjacent a marking representing a different arc.

* * * * *